US010724259B2

(12) United States Patent
Schimmel

(10) Patent No.: US 10,724,259 B2
(45) Date of Patent: Jul. 28, 2020

(54) RETRACTABLE MOBILE HOUSING WITH DOOR FOR A SANITARY FACILITY AND AN ASSEMBLY OF TWO OR MORE COUPLED HOUSINGS

(71) Applicant: Urilift Beheer B.V., Beemte-Broekland (NL)

(72) Inventor: Marten Alberto Schimmel, Beemte-Broekland (NL)

(73) Assignee: Urilift Beheer B.V., Beemte-Broekland (NL)

( * ) Notice: Subject to any disclaimer, the term of this patent is extended or adjusted under 35 U.S.C. 154(b) by 0 days.

(21) Appl. No.: 15/770,548

(22) PCT Filed: Oct. 26, 2016

(86) PCT No.: PCT/NL2016/050741
§ 371 (c)(1),
(2) Date: Apr. 24, 2018

(87) PCT Pub. No.: WO2017/074182
PCT Pub. Date: May 4, 2017

(65) Prior Publication Data

US 2019/0063090 A1 Feb. 28, 2019

(30) Foreign Application Priority Data

Oct. 26, 2015 (NL) ..... 2015663

(51) Int. Cl.
*E04H 1/12* (2006.01)
*A47K 11/00* (2006.01)
(Continued)

(52) U.S. Cl.
CPC ..... *E04H 1/1216* (2013.01); *A47K 3/325* (2013.01); *A47K 11/00* (2013.01); *E03D 7/00* (2013.01)

(58) Field of Classification Search
CPC ... E04H 1/1216; E04H 1/1244; E04H 1/1266; E04H 1/1277; E04H 1/14;
(Continued)

(56) References Cited

U.S. PATENT DOCUMENTS 3,774,955 A * 11/1973 Byer ..... B60P 3/34 296/171
4,844,538 A * 7/1989 Ricks ..... B60J 7/22 296/217
(Continued)

FOREIGN PATENT DOCUMENTS

DE 1927757 A1 * 10/1970 ..... E06B 3/921
DE 202005009772 U1 10/2005
(Continued)

OTHER PUBLICATIONS

International Search Report and Written Opinion received in PCT Application No. PCT/NL2016/050741, 10 pgs.
(Continued)

*Primary Examiner* — Erin Deery
(74) *Attorney, Agent, or Firm* — Moss & Barnett; Glen E. Schumann

(57) ABSTRACT

The invention relates to a sanitary facility (1) comprising a housing, wherein the housing is provided with a first housing part (10) and a second housing part (20), which is movable relative to the first housing part. The sanitary facility is configured for movement of the second housing part between a rest position and a position of use. The housing is provided with a door comprising at least a first and a second door segment (15, 25). The first housing part comprises the first door segment and the second housing part comprises the second door segment. The first door segment (15) takes a hollow form and the second door segment (25) is received slidably in the first door segment.

9 Claims, 12 Drawing Sheets

(51) Int. Cl.
*E03D 7/00* (2006.01)
*A47K 3/32* (2006.01)

(58) Field of Classification Search
CPC .... E04H 2001/1283; E04H 2001/1288; E04H 2001/1294; A47K 11/00; A47K 11/02; A47K 11/04; A47K 3/325; E03D 7/00; E04B 1/34869; E05D 7/1005; E05D 7/1044
See application file for complete search history.

(56) References Cited

U.S. PATENT DOCUMENTS

| | | | | |
|---|---|---|---|---|
| 5,379,466 | A | 1/1995 | Davies | |
| 8,770,422 | B2 * | 7/2014 | Cantin | E04B 1/3442 206/386 |
| 2009/0235445 | A1 | 9/2009 | Goldstein | |
| 2014/0259971 | A1 * | 9/2014 | Bikker | A47K 4/00 52/34 |

FOREIGN PATENT DOCUMENTS

| | | | |
|---|---|---|---|
| WO | WO2006029417 | A1 | 3/2006 |
| WO | WO2008089319 | A1 | 7/2008 |

OTHER PUBLICATIONS

Dutch Search Report and Written Opinion received in Dutch Application No. 2015663, 6 pgs.

* cited by examiner

RETRACTABLE MOBILE HOUSING WITH DOOR FOR A SANITARY FACILITY AND AN ASSEMBLY OF TWO OR MORE COUPLED HOUSINGS

REFERENCE TO RELATED APPLICATION

The present application claims priority to PCT Application No. PCT/NL2016/050741, filed Oct. 26, 2016, which claims priority to Netherland Application No. 2015663, filed Oct. 26, 2015, the contents of which is incorporated herein by reference in its entirety.

FIELD OF THE INVENTION

The invention relates to a housing for a sanitary facility, wherein the housing is provided with a first housing part and a second housing part, which is arranged movably relative to the first housing part, wherein the housing is configured for movement of the second housing part between a rest position and a position of use, wherein the housing is provided with one door, this door comprising at least a first and a second door segment, wherein the first housing part comprises the first door segment and wherein the second housing part comprises the second door segment.

BACKGROUND OF THE INVENTION

Such a sanitary facility is known from WO2008/089319. The known sanitary facility is configured as toilet facility and intended for mobile use at events, building sites or in emergency situations. The known sanitary facility has three housing parts which slide over each other.

The present invention has for its object to provide an improved sanitary facility of the type stated in the preamble, which is intended for mobile use and can be installed by one person in rapid and reliable manner using tools.

The sanitary facility according to the invention has for this purpose the feature that the first door segment takes a hollow form and that the second door segment is received slidably in the first door segment.

The hollow door segment of the first housing part guides the door segment of the second housing part. A reliable movement between the rest position and the position of use is thereby guaranteed. The sanitary facility according to the invention furthermore obtains a stable construction hereby. As a result, the sanitary facility according to the invention can be installed in the position of use, and be returned to the rest position after use, by only one person with the right tools. This produces a considerable saving in labour costs. In the rest position the sanitary facility according to the invention is about fifty percent smaller than in the position of use, so that twice as many sanitary facilities according to the invention will fit in the same space. This produces a considerable saving in transport and storage.

It is noted that a sanitary facility according to the preamble, wherein the first door segment takes a hollow form and the second door segment is received slidably in the first door segment, is known from NL2013846 (non-prepublished) of the same applicant. The known sanitary facility of applicant is intended for permanent placement in public spaces. A third, underground housing part and an integrated drive for the housing parts are present for this purpose.

SUMMARY OF THE INVENTION

In a first preferred embodiment each door segment is mounted on the respective housing part for pivoting between an open and a closed position. According to a further development of the first preferred embodiment the housing comprises a pivot pin, this pivot pin having an upper part which extends in the upper door segment and a lower part which extends in the lower door segment, wherein the upper part is received slidably in the lower part. The parts of the pivot pin which are slidable relative to each other ensure a correct position of the door during movement between the rest position and the position of use.

In a subsequent preferred embodiment the first housing part comprises first wall segments and first hollow tubular segments for mutually connecting the first wall segments, and the second housing part comprises second wall segments and second tube segments for mutually connecting the second wall segments, wherein the second tube segments are received slidably in the first hollow tubular segments. The tubes provide additional guidance between the first and second housing part and increase the reliable operation and stability of the sanitary facility according to the invention. The segmented tubes moreover strengthen the construction of the sanitary facility according to the invention.

In a practical elaboration of this subsequent preferred embodiment the housing comprises locking means for locking the second tube segments in the first tubular segments in the position of use, which locking means are arranged on the first tubular segments and engage on the second tube segments. The locking means on the tubes provide a very reliable and safe four-point locking.

According to a further preferred embodiment, the first housing part is provided with a bottom and the second housing part is provided with a roof. The bottom and the roof respectively each form a span structure of respectively the first housing part and the second housing part, whereby the construction of the sanitary facility according to the invention is strengthened still further.

According to an elegant preferred embodiment, the bottom and/or the roof are provided with openings for receiving forks of a forklift truck. Using a forklift truck, one person can advantageously carry out the whole process of storage, installation and dismantling.

According to a practical preferred embodiment, the bottom and/or the roof are provided with positioning elements for stacking sanitary facilities in the rest position.

The first housing part is preferably provided with arresting means for arresting the first door segment in the closed position. Applying arresting means increases the reliability of the sanitary facility according to the invention.

The sanitary facility according to the invention is preferably intended as toilet facility, wherein one or more receptacles for human excrement and/or urine are arranged in the first housing part. A storage reservoir is optionally arranged in the bottom, and the one or more receptacles are connected to the storage reservoir. The one or more receptacles are alternatively connectable to a waste pipe for connection to an existing sewage system.

In another preferred embodiment the first housing part is provided with hollow first wall segments in which second wall segments of the second housing part are slidably received.

In an optimal preferred embodiment the housing is a single-person cabin.

In a compact preferred embodiment the housing has a generally rectangular cross-section.

In this compact preferred embodiment the sanitary facility according to the invention has optimal stackability, and a plurality of sanitary facilities can be loaded into a truck or stored in a storage space as efficiently as possible.

The invention also relates to an assembly of two or more housings according to the invention, wherein the assembly further comprises coupling means for coupling the housings. The assembly can comprise an optimal configuration of different types and numbers of housings. Owing to the coupling, the assembly can be handled as a whole during transport and installation and use. The first and the second housing part are preferably provided with openings for passage of the coupling means.

BRIEF DESCRIPTION OF THE DRAWINGS

The invention will now be described in more detail with reference to the figures.

FIG. 1D shows the schematic view of FIG. 1A from a different viewpoint;

FIGS. 1E-H show parts of FIG. 1D in more detail;

DETAILED DESCRIPTION OF THE INVENTION

Figure 1A:
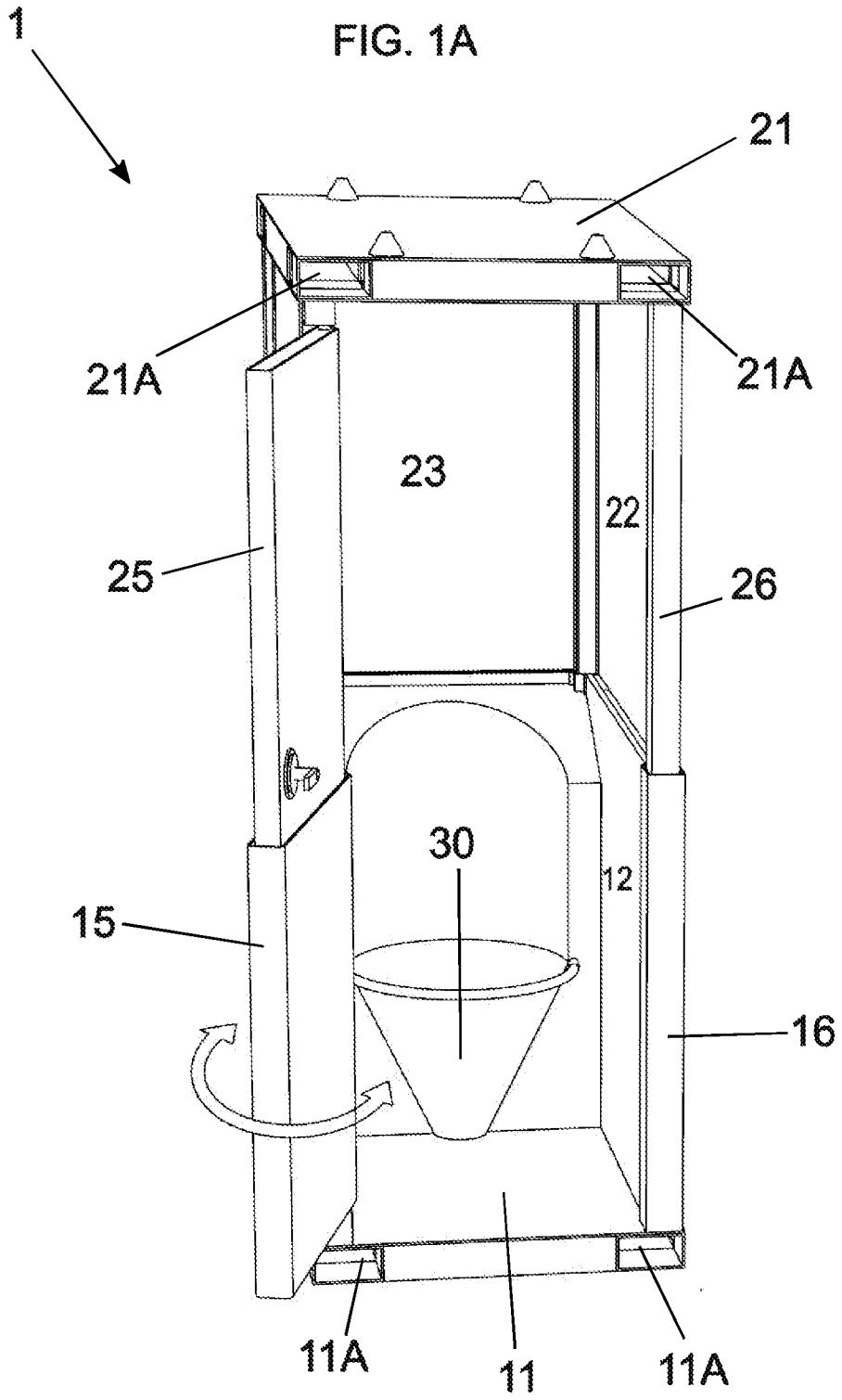
FIG. 1A shows a schematic view of a first preferred embodiment of a sanitary facility according to the invention in position of use with open door.
Figure 1B:
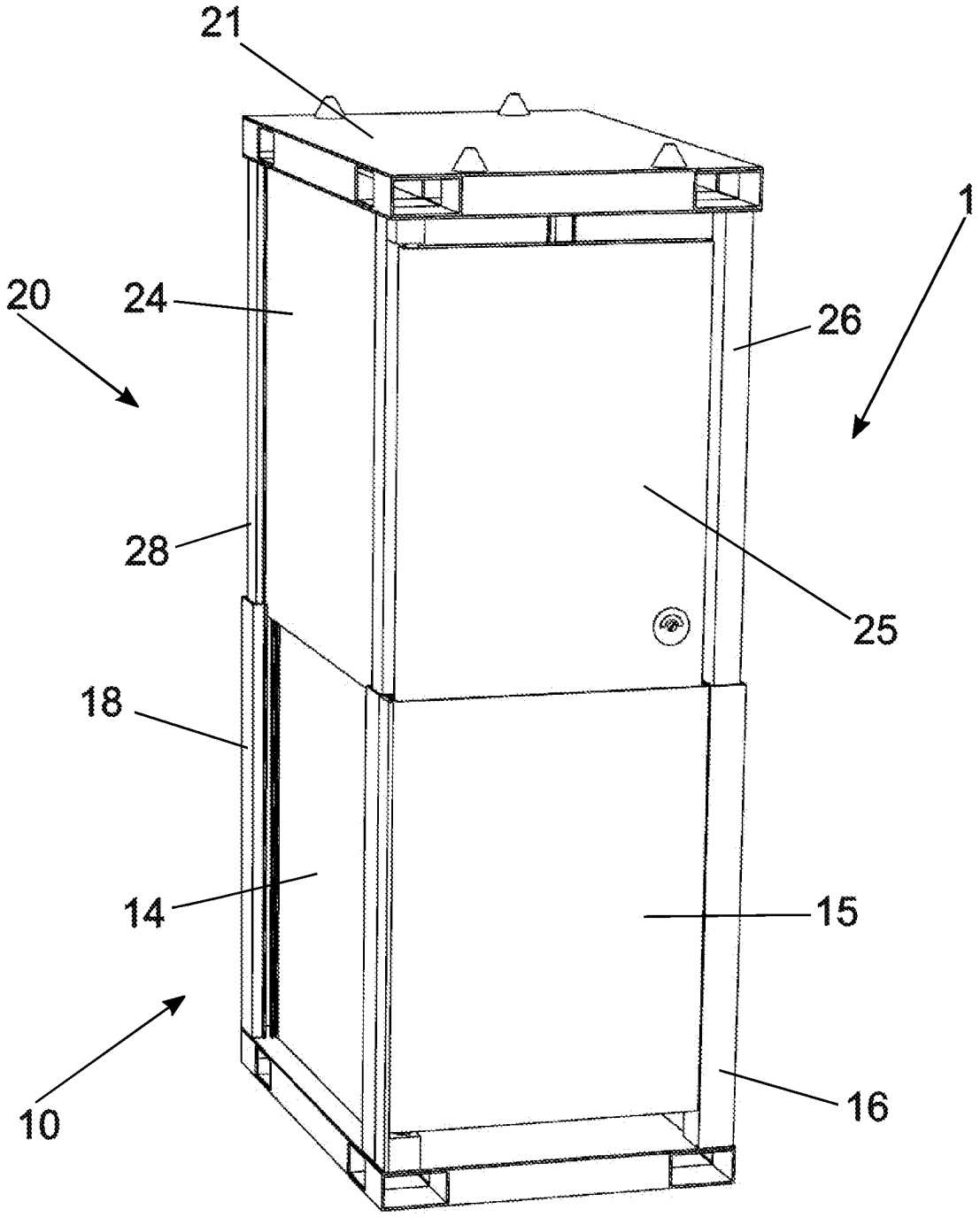
FIG. 1B shows a schematic view of the sanitary facility of FIG. 1A in position of use with closed door.
Figure 1C:
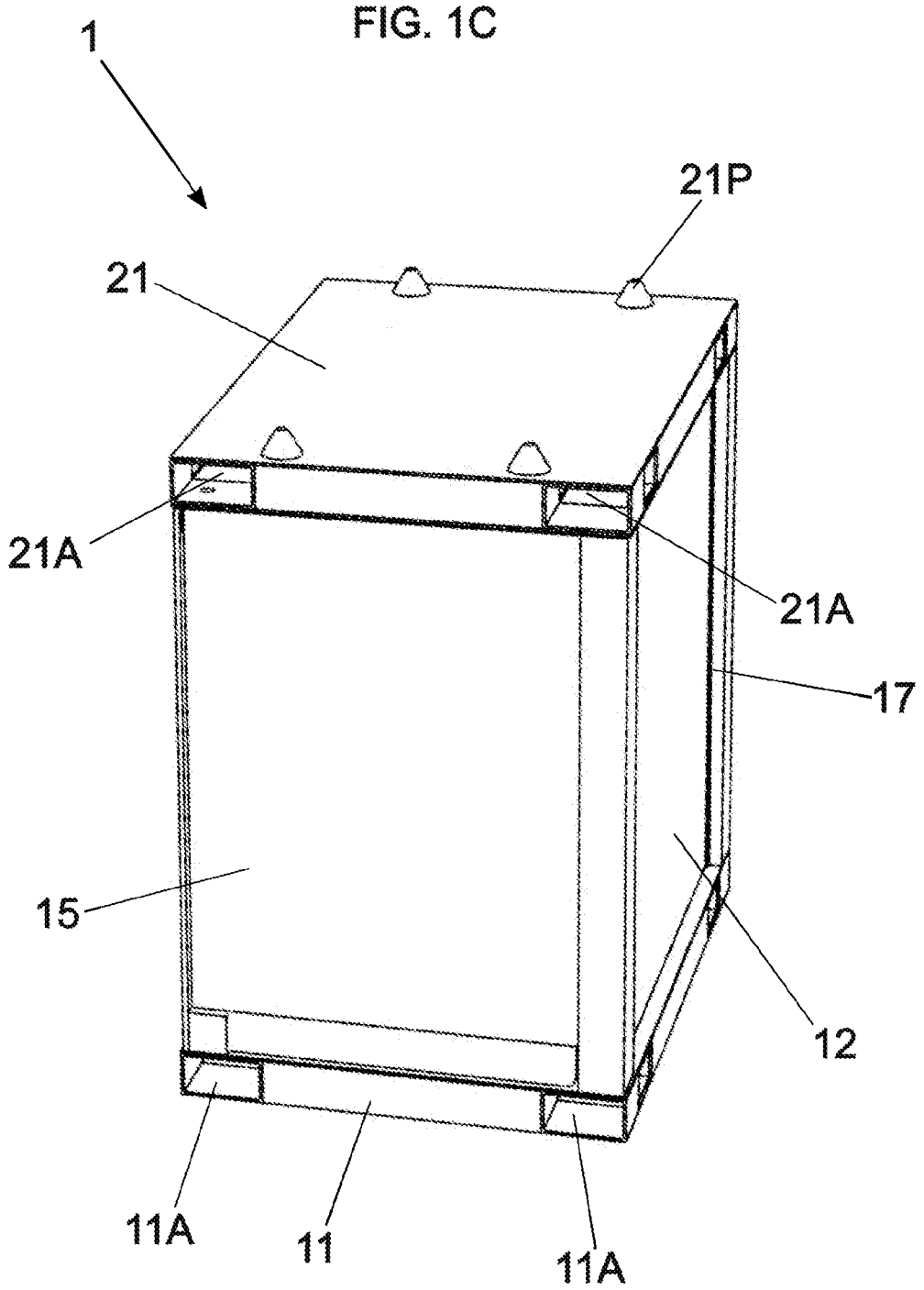
FIG. 1C shows a schematic view of the sanitary facility of FIG. 1B in rest position.

FIGS. 1A, 1B and 1C show a first preferred embodiment of a housing for a sanitary facility 1 according to the invention in various positions. FIG. 1A shows sanitary facility 1 with open door in position of use. FIG. 1B shows sanitary facility 1 with closed door, likewise in position of use, and FIG. 1C shows sanitary facility 1 with closed door in rest position.

Sanitary facility 1 comprises two housing parts slidable relative to each other. A first housing part 10 comprises a bottom 11 from which first wall segments 12, 13 and 14 extend. First housing part 10 further comprises a first door segment 15. A second housing part 20 comprises a roof or cover 21 from which second wall segments 22, 23 and 24 extend. Second housing part 20 further comprises a second door segment 25.

In the shown preferred embodiment wall segments 12, 22 form a side wall, as do wall segments 14, 24. Wall segments 13, 23 form a rear wall.

In the shown preferred embodiment the sanitary facility is intended for use as toilet. A receptacle 30 for human excrement and/or urine is arranged for this purpose in first housing part 10. Receptacle 30 is placed against first wall segment 13 of the rear wall.

According to the invention, first door segment 15 takes a hollow form and second door segment 25 is received slidably in the first door segment. In the shown preferred embodiment the respective first wall segments 12 and 14 also take a hollow form, and the respective second wall segments 22 and 24 are received slidably therein. Second wall segment 23 preferably slides along first wall segment 13.

First door segment 15 is mounted pivotally on first housing part 10 and second door segment 25 is mounted pivotally on second housing part 20. In the position of use the door is thereby a hinged door pivotable between the open position in FIG. 1A and the closed position in FIG. 1B.

In the shown preferred embodiment respective adjacent first wall segments 12, 13 and 13, 14 in first housing part 10 are mutually connected by respective first tube segments 17 and 18. Respective adjacent second wall segments 22, 23 and 23, 24 in second housing part 20 are likewise mutually connected by means of respective second tube segments 27 and 28. In the shown preferred embodiment a first tube segment 16 is likewise situated on the front side between first door segment 15 and first wall segment 12. In second housing part 20 a second tube segment 26 is arranged between second door segment 25 and second wall segment 22. First door segment 15 is mounted on a first tube segment 19 arranged adjacently of first wall segment 14. Second door segment 25 is mounted on a second tube segment 29 arranged adjacently of second wall segment 24. First tube segments 16, 17, 18, 19 take a hollow form and second tube segments 26, 27, 28, 29 are received slidably therein.

Sanitary facility 1 was developed to be moved between the rest position and the position of use by one person using mechanical aids. In the shown preferred embodiment roof 21 of sanitary facility 1 is provided with openings 21A for receiving the forks of a forklift truck. Openings 21A are intended for sliding of second housing part 20 relative to first housing part 10. Bottom 11 is likewise provided with openings 11A for receiving the forks of the forklift truck. Openings 11A are intended for transport of the whole sanitary facility 1 in the rest position.

A mechanical drive, such as a spindle, can be arranged in sanitary facility 1 as an alternative to using a forklift truck. One or more spindles can for instance be accommodated in the tubes.

Sanitary facility 1 is provided with locking means for locking second housing part 20 relative to first housing part 10 in the position of use. Diverse locking means, which are per se known in the relevant field, can be applied for this purpose.

First housing part 10 is further provided with arresting means for arresting first door segment 15 relative to first wall segment 12, particularly first tube segment 16, in the closed position of the door.

Arranged on roof 21 are positioning elements in the form of protrusions 21P for stacking sanitary facilities 1 in the rest position. Bottom 11 of the sanitary facility is optionally provided with recesses (not shown) co-acting with the positioning protrusions.

FIG. 1D shows sanitary facility 1 in the position of use with open door from a different angle. FIGS. 1E-H show parts of FIG. 1D on enlarged scale.

The door of sanitary facility 1 is provided with a lock 33 which can be arranged as desired on lower door segment 15 or on upper door segment 25. Lock 33 can, as desired, be a mortice lock or a rim lock.

FIGS. 1E, 1F and 1G show schematic views to illustrate the pivoting movement S of the door. In FIGS. 1E and 1G the door segment has been broken away. Sanitary facility 1 comprises a pivot pin consisting of two parts. Upper part 35 of the pivot pin extends in upper door segment 25 and is fixed to a bearing block 36 in roof 21. Lower part 34 of the pivot pin extends in lower door segment 15 and is mounted on a bearing block 37 in bottom 11. Upper part 35 of the pivot pin is preferably received slidably in lower part 34.

Figure 1H:
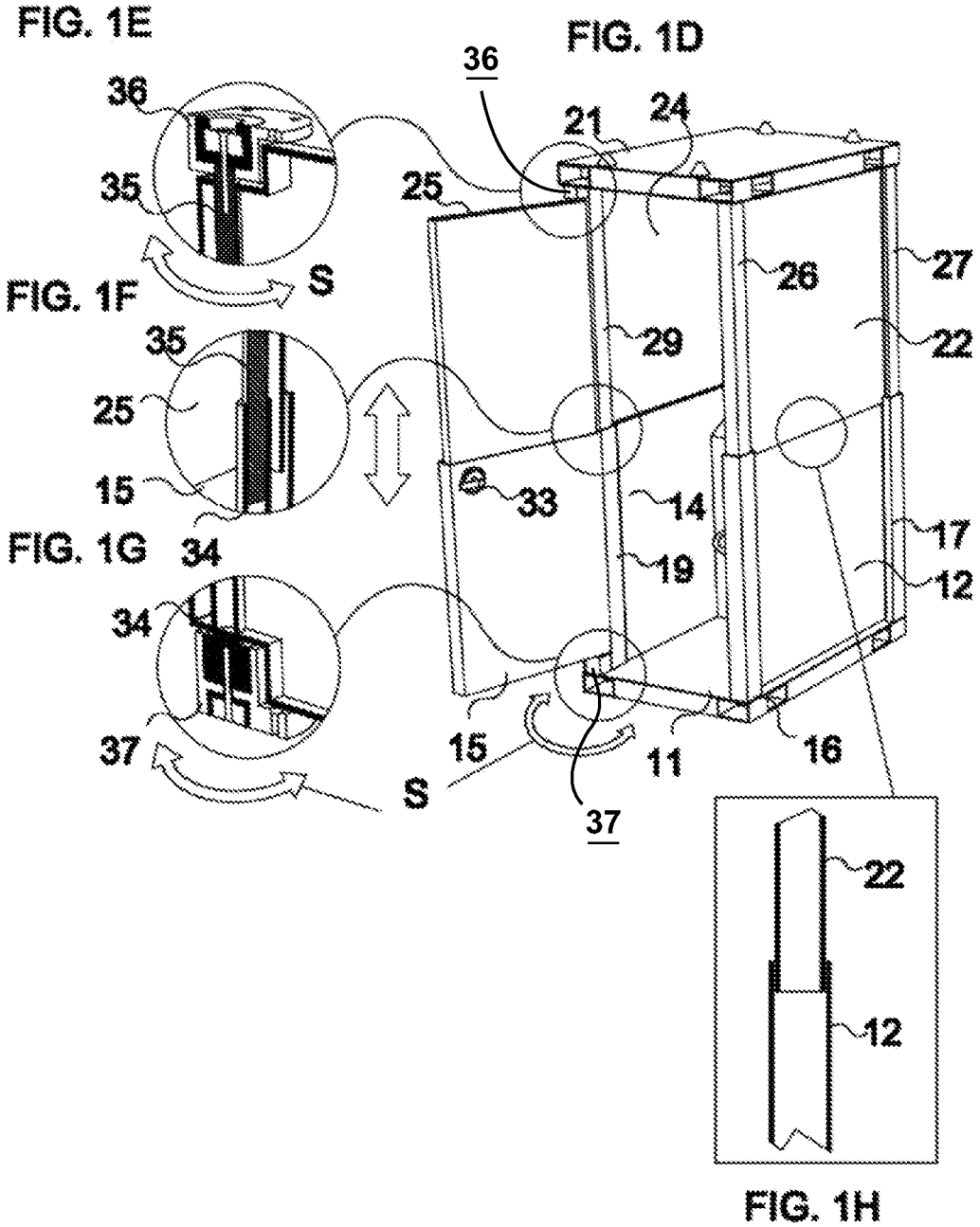

FIG. 1H illustrates a cross-section through a side wall with the hollow first wall segment 12, in which second wall segment 22 is slidably received.

In the shown preferred embodiment the housing of sanitary facility 1 has a generally rectangular cross-section. The wall segments of sanitary facility 1 form a frame with a generally U-shaped cross-section. This U-shaped frame is preferably embodied in metal. The door segments are preferably embodied in plastic material.

For the purpose of discharge of waste water from the sanitary facility, receptacles 30 can be connectable to a waste pipe for connection to a sewage system. In an alternative embodiment first housing part 10 is provided with a storage reservoir (not shown) to which receptacles 30 are connected. The storage reservoir can be accommodated in bottom 11.

Figure 2A:
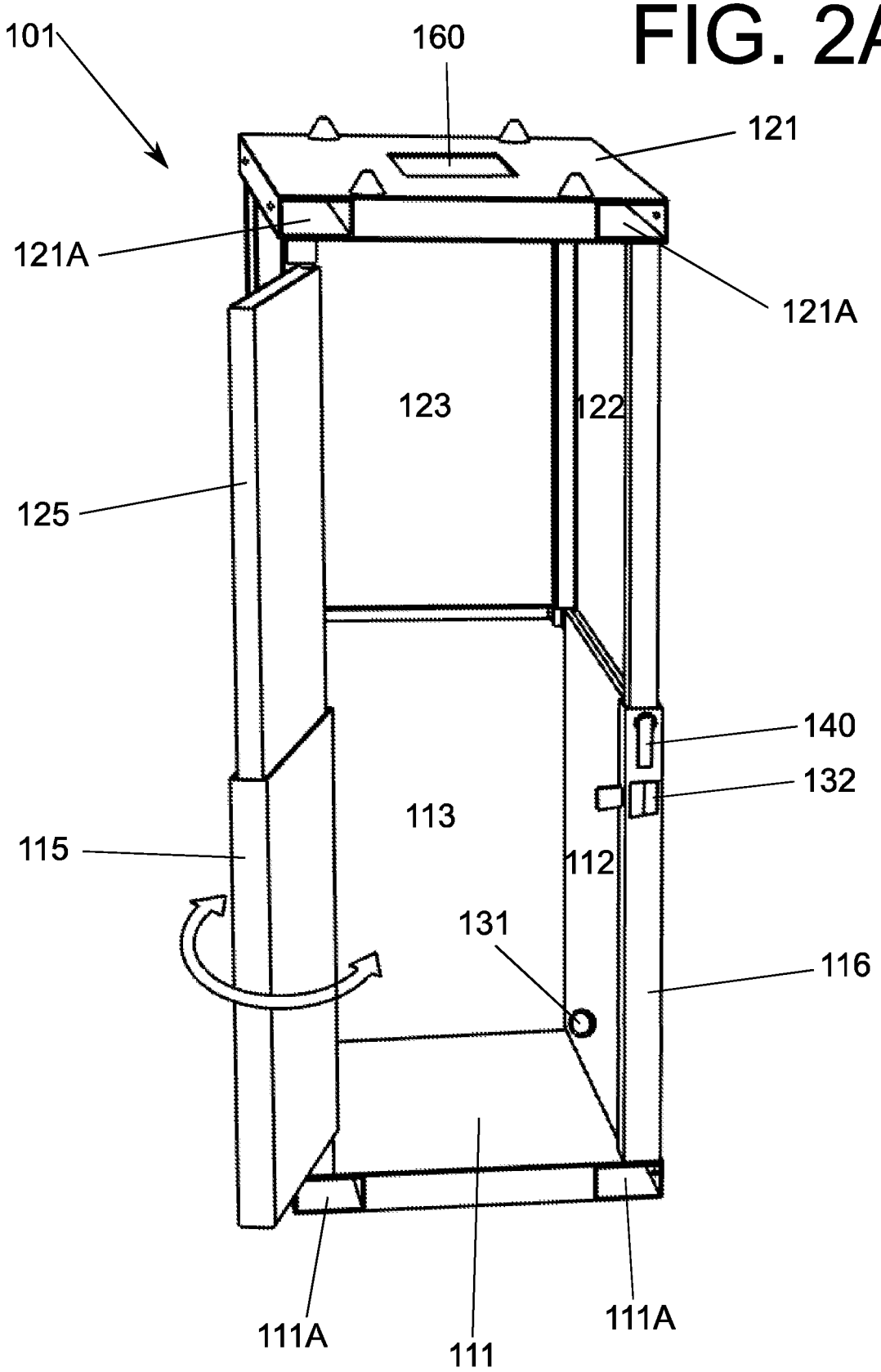
FIG. 2A shows a schematic view of a cabin as second preferred embodiment of the invention in position of use with open door.
Figure 2B:
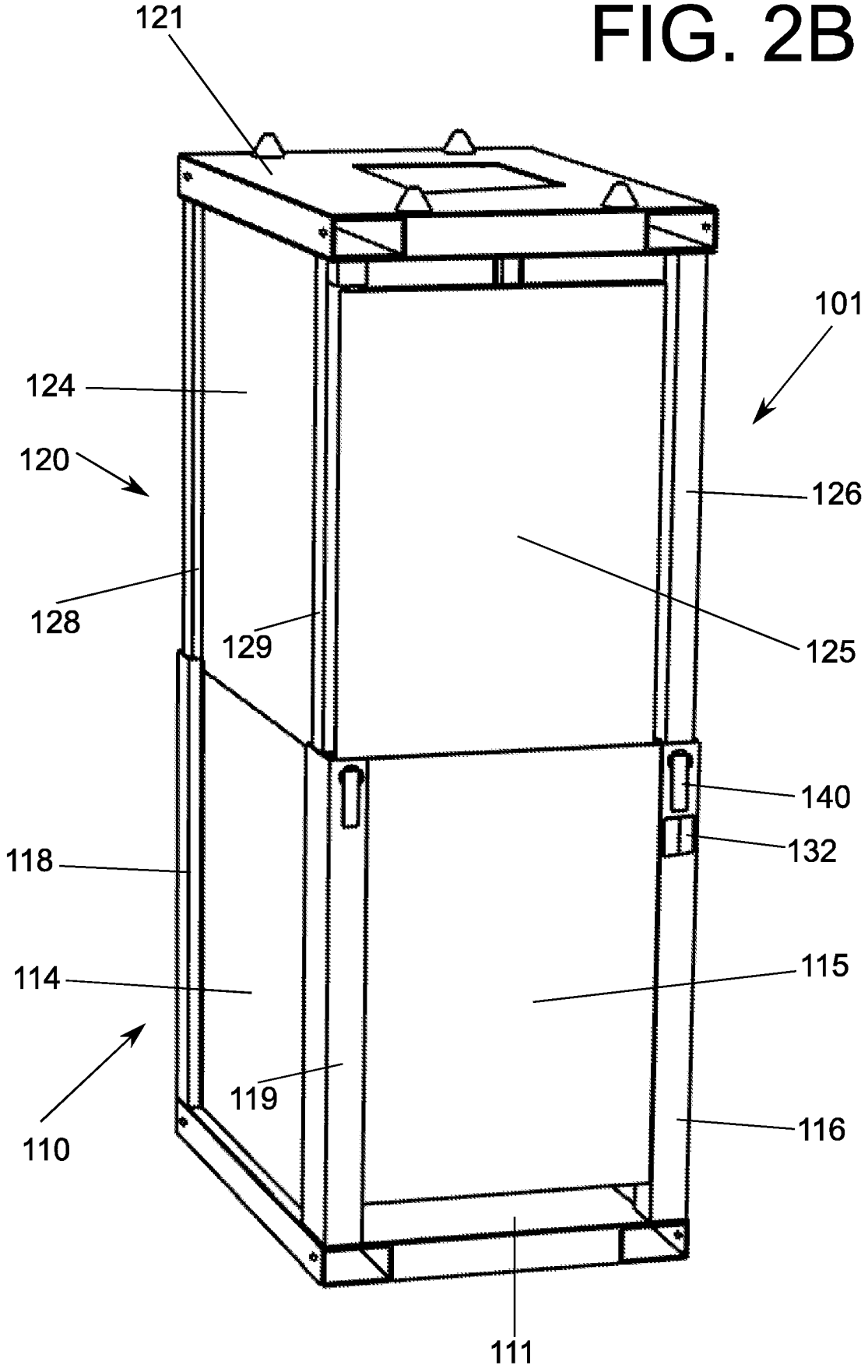
FIG. 2B shows a schematic view of the cabin of FIG. 2A in position of use with closed door.
Figure 2C:
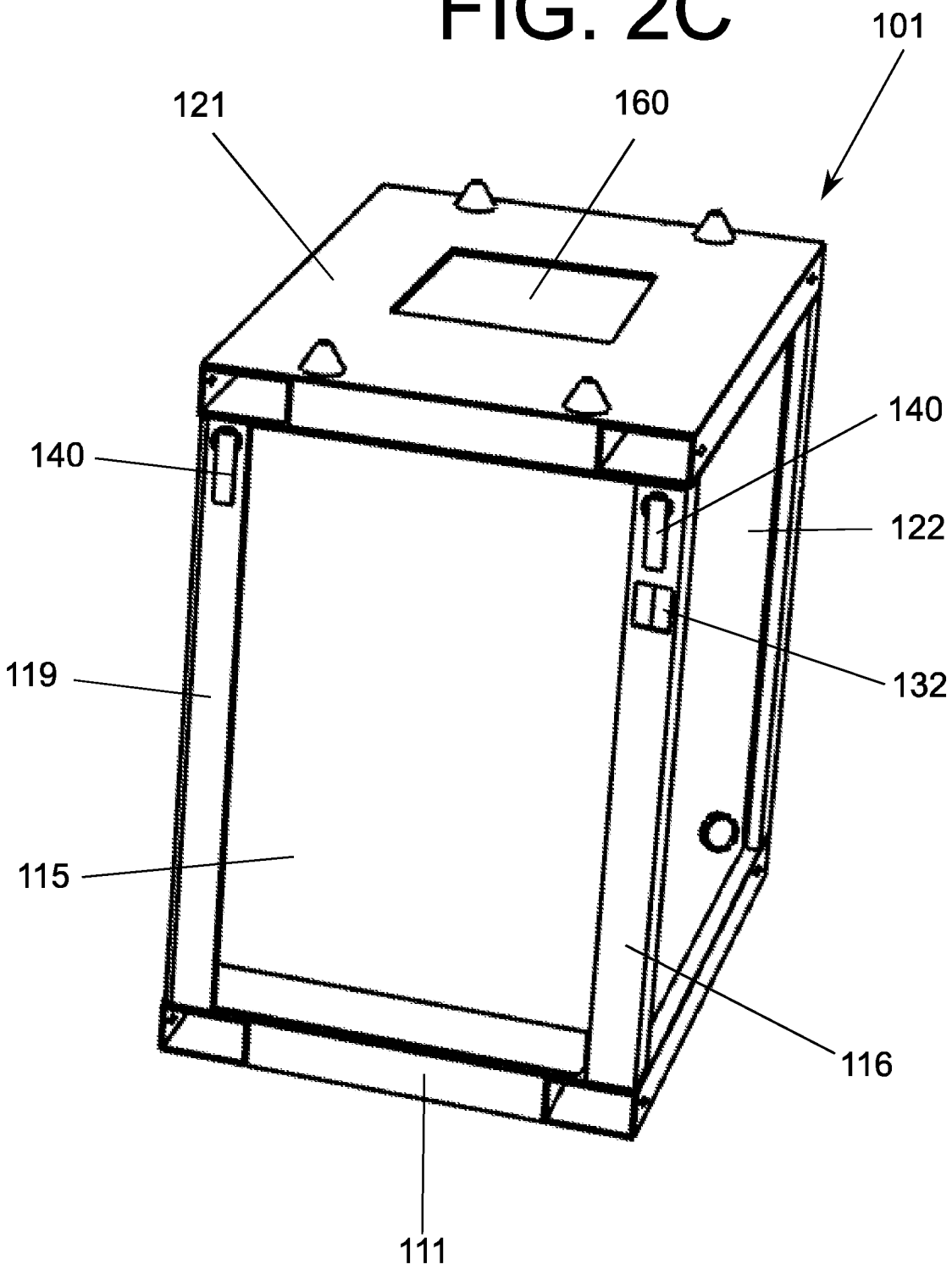
FIG. 2C shows a schematic view of the cabin of FIG. 2B in rest position.

FIGS. 2A, 2B and 2C show a second preferred embodiment of a housing 101 according to the invention in various positions. FIG. 2A shows housing 101 with open door in position of use. FIG. 2B shows housing 101 with closed door, likewise in position of use, and FIG. 2C shows housing 101 with closed door in rest position.

Housing 101 is intended and suitable for use as sanitary facility. Housing 101 is a cabin, more particularly a single-person cabin, in which desired sanitary fixtures can be arranged, such as a receptacle, a sink or a shower. Cabin 101 can however also be configured for a different application, for instance as changing facility or box office booth.

Cabin 101 comprises two housing parts 110, 120 which are slidable relative to each other. A first housing part 110 comprises a bottom 111 from which first wall segments 112, 113 and 114 extend. First housing part 110 further comprises a first door segment 115. A second housing part 120 comprises a roof or cover 121 from which second wall segments 122, 123 and 124 extend. Second housing part 120 further comprises a second door segment 125.

As in sanitary facility 1, first door segment 115 takes a hollow form and second door segment 125 is received slidably in the first door segment.

In the shown second preferred embodiment the second wall segments 122, 123 and 124 slide along first wall segments 112, 113 and 114.

In first housing part 110 respective adjacent first wall segments 112, 113 and 113, 114 are mutually connected by respective first tubular segments 117 and 118. In second housing part 120 respective adjacent second wall segments 122, 123 and 123, 124 are likewise mutually connected by means of respective second tube segments 127 and 128. In the shown preferred embodiment a first tubular segment 116 is likewise situated on the front side between first door segment 115 and first wall segment 112. In second housing part 120 a second tube segment 126 is arranged between second door segment 125 and second wall segment 122. First door segment 115 is mounted on a first tubular segment 119 which is arranged adjacently of first wall segment 114. Second door segment 125 is mounted on a second tube segment 129 arranged adjacently of second wall segment 124. The first tubular segments 116, 117, 118, 119 take a hollow form and the second tube segments 126, 127, 128, 129 are received slidably therein. First tubular segments 116, 117, 118, 119 further take a partially open form so as to enable movement of the second wall segments along the first wall segments. First tubular segments 116, 117, 118, 119 can be preformed in the first wall segments. Within the context of the present invention, tubular segments 116, 117, 118, 119 function as first tubes for receiving second tube segments 126, 127, 128, 129.

Arranged on all first tubular segments 116, 117, 118, 119 are locking means 140 which are configured to lock the respective second tube segment therein.

Figure 2D:
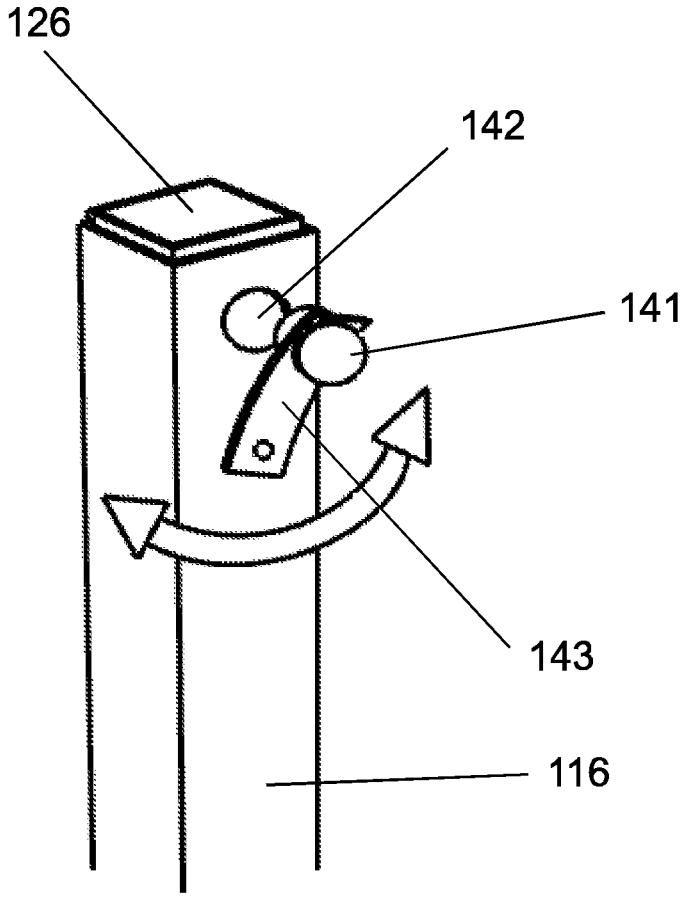
FIG. 2D shows a part of FIG. 2A schematically in more detail.

FIG. 2D shows locking means 140 for locking cabin 101 in the position of use of FIG. 2A in more detail. Locking means 140 comprise a locking element 141 which is arranged on first tubular segment 116 by means of a flexible attachment 143. First tubular segment 116 is further provided with a first opening 142 for receiving locking element 141. Second tube segment 126 is provided with a second opening which, in the position of use of cabin 101, lies in line with the first opening 142 for receiving locking element 141.

Cabin 101 is further provided with a lock 132. In the second preferred embodiment lock 132 is a sliding lock for mutually locking first tubular segment 116 and first door segment 115.

Cabin 101 is preferably embodied in metal, more preferably aluminium. In the shown second preferred embodiment a skylight 160 is arranged in the roof. Further arranged in first housing part 110 is a connection 131 for supply and discharge of (waste) water.

The other technical measures of cabin 101 correspond to the technical measures of the housing of sanitary facility 1, as described above. All corresponding reference numerals are increased by 100.

In the shown preferred embodiment cabin 101 is configured for coupling to an adjoining cabin.

Figure 3A:
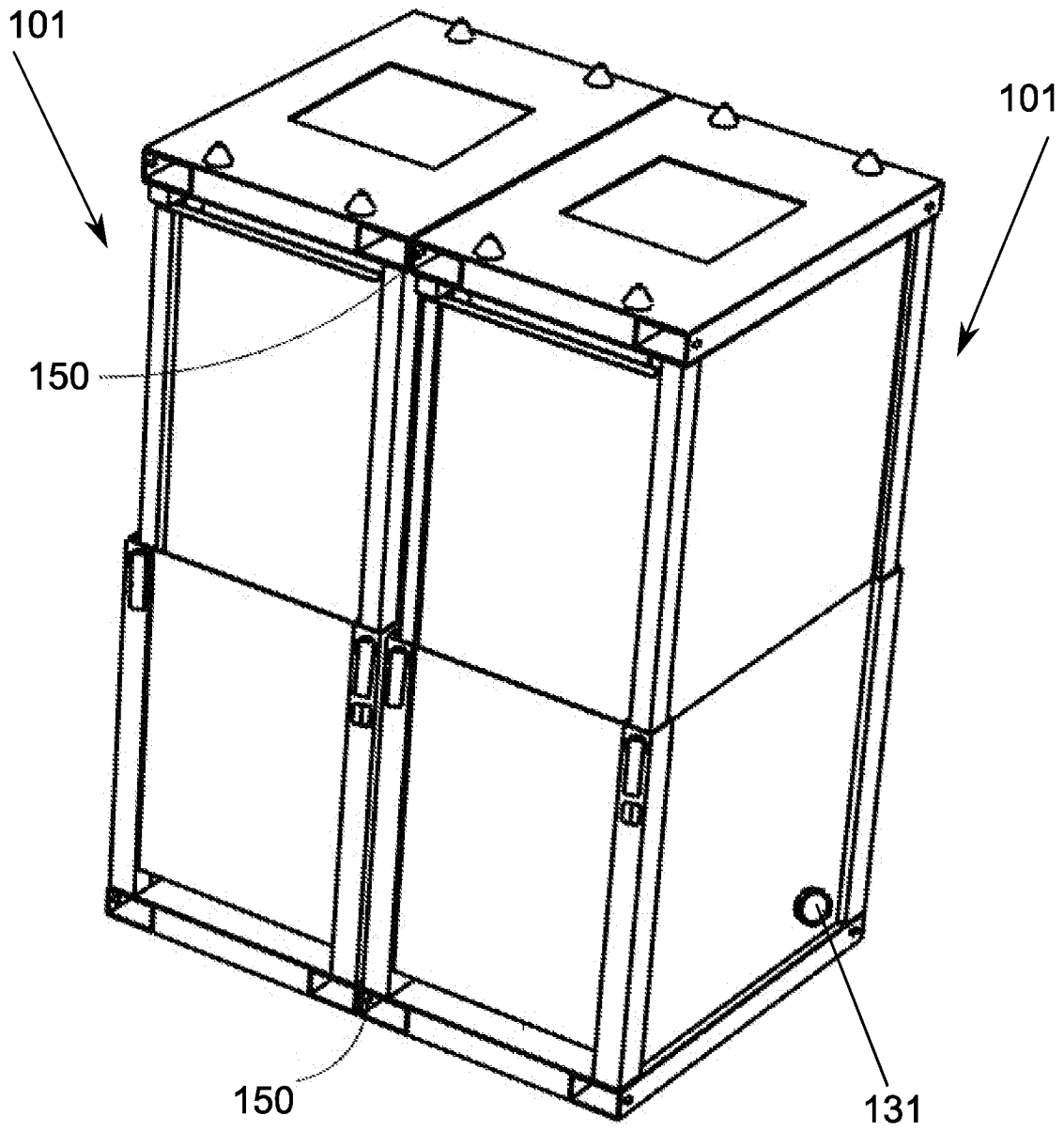
FIG. 3A shows a schematic view of an assembly of two coupled cabins in the position of use.
Figure 3B:
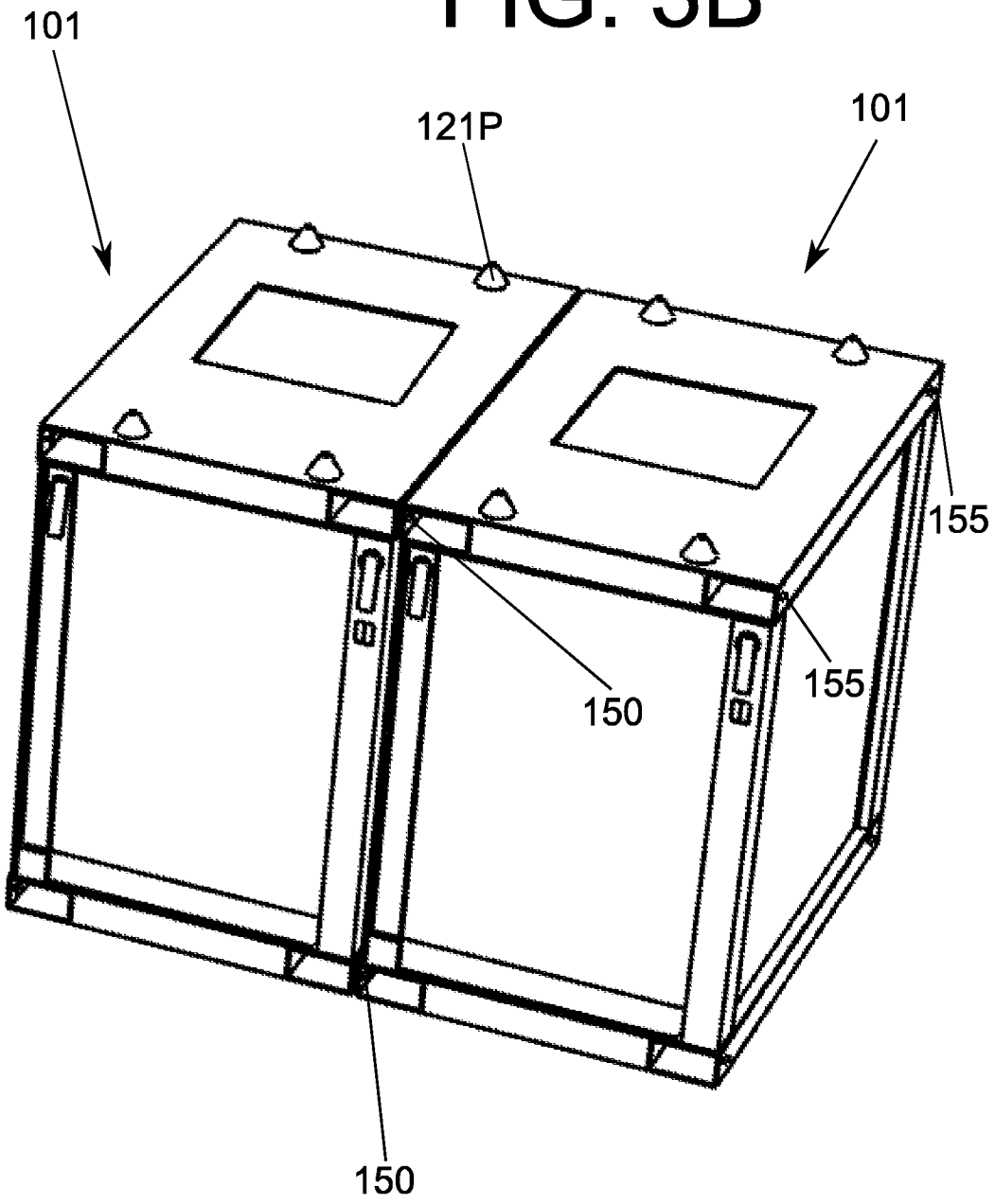
FIG. 3B shows a schematic view of the two coupled cabins of FIG. 3A in the rest position.

FIGS. 3A and 3B illustrate an assembly of two coupled cabins 101 in respectively the position of use and the rest position.

Figure 3C:
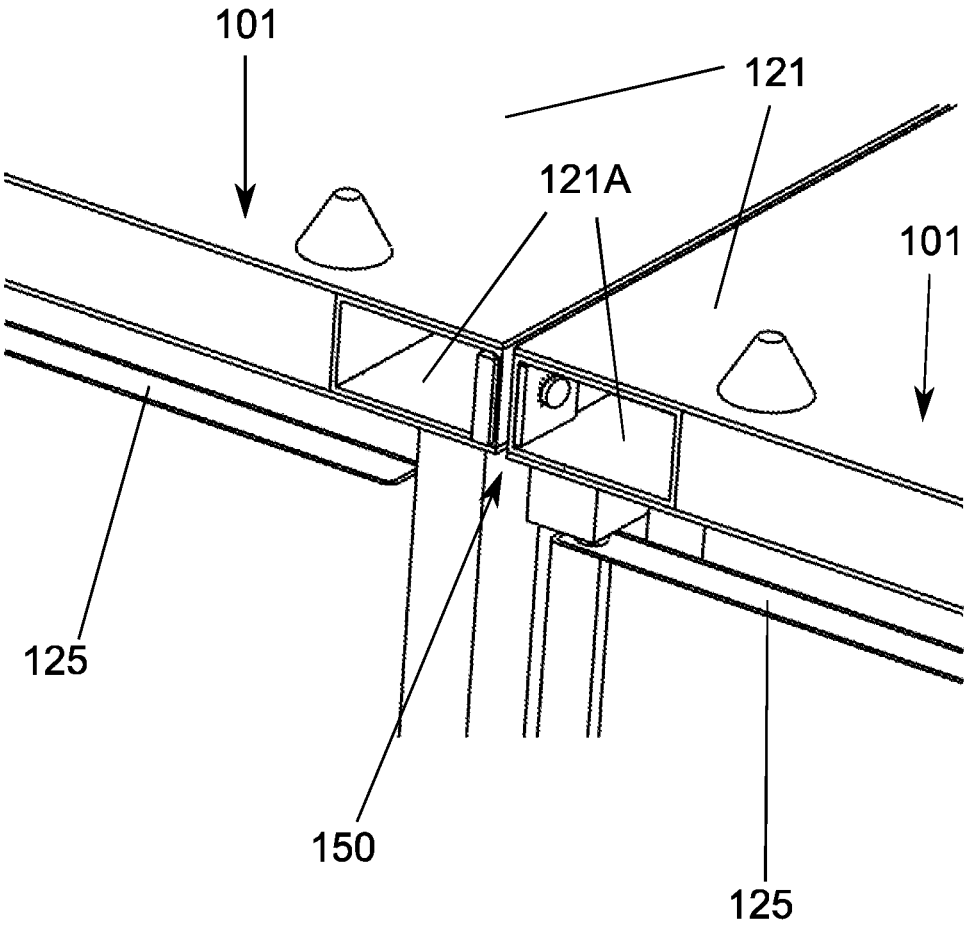
FIG. 3C shows a part of FIG. 3A schematically in more detail.
Figure 3D:
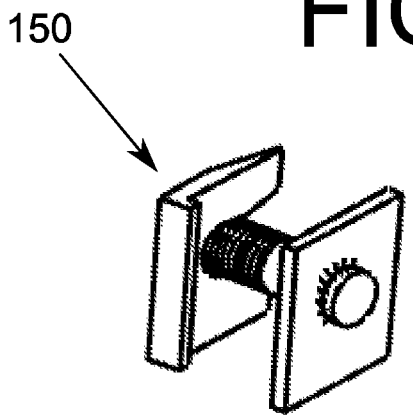
FIG. 3D shows a part of FIG. 3C schematically in more detail.
Figure 3E:
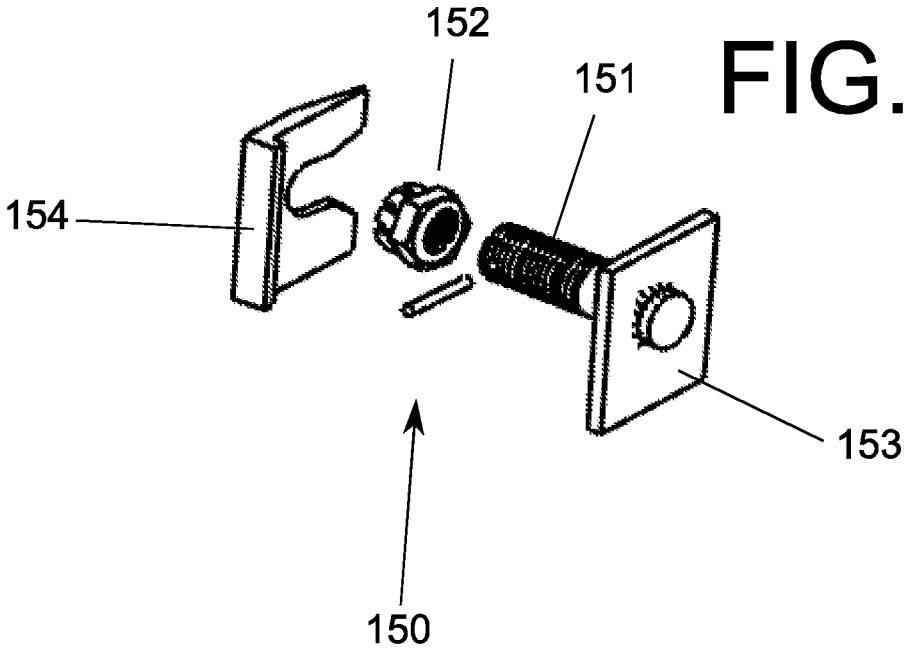
FIG. 3E shows the view of FIG. 3D with exploded parts.

FIGS. 3C and 3D show coupling means 150 for coupling the cabins 101 of FIG. 3A in more detail. FIG. 3D shows coupling means 150 in assembled state. FIG. 3E shows coupling means 150 with exploded parts. Coupling means 150 form a bolt-nut connection with a bolt 151 and a nut 152. The bolt is fastened fixedly to a coupling plate 153. A clamping foot 154 is further provided. Cabins 101 are each provided with a number of openings 155 for receiving bolts 151. In the shown preferred embodiment openings 155 are arranged on the sides of roof 121 and on the sides of floor 111. The holes preferably debouch into openings 121A and 111A for co-action with the forks of a forklift truck, which provide space for assembly.

Cabins 101 are configured such that in coupled state they can be together connected to water, electrics and/or a sewer system. Connections 131 are preferably mutually connectable to a shared pump with shredding unit. The cabins are further preferably connected to a shared supply container with water. Such equipment is preferably accommodated in a separate housing, which can be added to the assembly.

The present invention relates to a mobile retractable housing forming a closable accommodation for one person. A plurality of housings according to the invention can be coupled to form an assembly. The invention is expressly not limited to the shown and described preferred embodiments. Other variants in form and dimensions of the housing lie within the reach of a skilled person in the field on the basis of this text. Other or additional coupling means for coupling the housings to form an assembly comprise a frame in which the assembly can be placed, or aligning elements, such as box girders, with which to align and connect the housings in an assembly.

Although the invention is illustrated on the basis of preferred embodiments with two housing parts, it is also possible to embody the sanitary facility with one or more further housing parts which are received as intermediate housing parts between the first housing part and the second housing part. The number of door segments is then equal to the number of housing parts.

The invention therefore extends to any embodiment falling within the scope of protection as defined in the claims and seen in the light of the foregoing description and accompanying drawings.

The invention claimed is:

1. A housing for a sanitary facility, wherein the housing is provided with a first housing part and a second housing part, which is arranged movably relative to the first housing part, wherein the housing is configured for movement of the second housing part between a rest position and a position of use, wherein the housing is provided with a door, the door comprising at least a first and a second door segment, wherein the first housing part comprises the first door segment and wherein the second housing part comprises the second door segment, wherein the first door segment takes a hollow form and the second door segment is received slidably in the first door segment, wherein the first housing part is provided with a bottom and wherein the second housing part is provided with a roof, wherein each door segment is mounted on the respective housing part for pivoting between an open and a closed position, wherein the housing comprises a pivot pin, the pivot pin having an upper part which starts at a bearing block in the roof and extends in the second door segment and a lower part which starts at a bearing block in the bottom and extends in the first door segment, wherein the lower part overlaps the upper part and wherein the upper part is slidably arranged in the lower part.

2. The housing as claimed in claim 1, wherein the first housing part comprises first wall segments and first hollow tubular segments for mutually connecting the first wall segments, wherein the second housing part comprises second wall segments and second tube segments for mutually connecting the second wall segments, wherein the second tube segments are received slidably in the first hollow tubular segments.

3. The housing as claimed in claim 2, comprising a locking means for locking the second tube segments in the first tubular segments in the position of use, wherein the locking means is arranged on the first tubular segments and engage on the second tube segments.

4. The housing as claimed in claim 2, wherein the first wall segments are hollow and the second wall segments of the second housing part are slidably received in the hollow first wall segments.

5. The housing as claimed in claim 1, wherein the bottom and/or the roof are provided with openings for receiving forks of a forklift truck.

6. The housing as claimed in claim 1, wherein the bottom and/or the roof are provided with positioning elements for stacking sanitary facilities in the rest position.

7. The housing as claimed in claim 1, wherein the first housing part is provided with an arresting means for arresting the first door segment in the closed position.

8. The housing as claimed in claim 1, wherein one or more receptacles for human excrement and/or urine are arranged in the first housing part.

9. The housing as claimed in claim 1, wherein the housing is a single-person cabin.

* * * * *